US008746545B2

(12) United States Patent
Houck

(10) Patent No.: US 8,746,545 B2
(45) Date of Patent: Jun. 10, 2014

(54) DRINK CUP FOR ROAD RUNNING RACES

(76) Inventor: Russell E. Houck, Syracuse, NY (US)

( * ) Notice: Subject to any disclaimer, the term of this patent is extended or adjusted under 35 U.S.C. 154(b) by 155 days.

(21) Appl. No.: 13/570,298

(22) Filed: Aug. 9, 2012

(65) Prior Publication Data

US 2014/0042217 A1 Feb. 13, 2014

(51) Int. Cl.

| | |
|---|---|
| ***B65D 3/20*** | (2006.01) |
| ***B65D 3/28*** | (2006.01) |
| *B65D 5/74* | (2006.01) |

(52) U.S. Cl.

USPC ..... 229/128; 229/5.5; 229/404

(58) Field of Classification Search

CPC ..... B65D 3/20; B65D 43/16; B65D 43/162; B65D 2251/1016; B65D 2251/1083; B65D 3/28; B65D 5/74; B65D 5/741; A47G 19/2272

USPC ..... 229/5.5, 128, 404, 906.1; 222/462, 572, 222/574

See application file for complete search history.

(56) References Cited

U.S. PATENT DOCUMENTS

| | | | | |
|---|---|---|---|---|
| 667,634 | A * | 2/1901 | Schmidt | 229/128 |
| 3,357,623 | A * | 12/1967 | Wommelsdorf | 229/402 |
| 3,809,310 | A * | 5/1974 | VanderLugt, Jr. | 229/110 |
| 4,083,447 | A * | 4/1978 | Walters et al. | 229/5.5 |
| 5,960,987 | A | 10/1999 | Solland et al. | |
| 6,164,488 | A | 12/2000 | Solland et al. | |
| 6,176,420 | B1 | 1/2001 | Sarson et al. | |
| D469,691 | S | 2/2003 | Brondyke et al. | |
| 6,592,504 | B2 | 7/2003 | Sarson et al. | |
| 6,758,390 | B2 | 7/2004 | Howes-Jones et al. | |
| D495,209 | S | 8/2004 | Tranfaglia et al. | |
| D502,364 | S | 3/2005 | Chan | |
| D605,895 | S | 12/2009 | Abbott | |
| 7,726,551 | B2 | 6/2010 | Abbott | |
| D637,872 | S | 5/2011 | Sarson | |
| D657,950 | S | 4/2012 | Herman | |
| 8,505,807 | B2 * | 8/2013 | Herman | 229/128 |
| 2006/0124718 | A1 * | 6/2006 | Matty | 229/400 |
| 2006/0266816 | A1 * | 11/2006 | Voigt | 229/400 |
| 2010/0314434 | A1 | 12/2010 | Herman | |
| 2012/0286027 | A1 * | 11/2012 | Lu et al. | 229/404 |
| 2012/0292382 | A1 * | 11/2012 | Cai et al. | 229/404 |

* cited by examiner

*Primary Examiner* — Gary Elkins

(74) *Attorney, Agent, or Firm* — Bernhard P. Molldrem, Jr.

(57) ABSTRACT

A water-station drink cup for running races has a square cutout at a front or proximal side, and arcuate upper edges along a radius on each side from the top of the verticals of the cutout to a common point on the opposite side. Radiused perforations create fold lines that extend from the bottom of each side of the vertical to meet at that common point. This creates two flaps of a double-radiused ogive shape. The flaps are pushed down one onto the other to close the top, leaving a drink opening at the distal side, corresponding to the square cutout.

8 Claims, 5 Drawing Sheets

DRINK CUP FOR ROAD RUNNING RACES

FIELD OF THE INVENTION

The present invention relates to drink cups, especially small disposable cups that are frequently used at water stations along the course of a road race where runners may grab a cup filled with water or an electrolyte drink. The invention is more specifically directed to a drink cup that has a top or closure formed from an upper part of the conical side wall of the cup, and in which flaps on either side fold down to form a drink spout at one side of the cup, so the runner can drink comfortably out of the cup without the water spilling or splashing out.

BACKGROUND OF THE INVENTION

In running road races, e.g., marathons, half-marathons, 10-kilometer race, 5-kilometer races, other distance runs, or in cross-country ski races, there are typically water stations or water stops along the course where participants can grab a paper cup with water to re-hydrate during the race. Invariably, inexpensive common paper cups are used for this purpose because a large number of cups are required and the paper cups will be used only once and then discarded. The cups are usually filled and placed on a table alongside the race course where they can be grabbed quickly by a runner when passing the table, or where a volunteer can hand the container and water to the runner. In some cases, an electrolyte drink, e.g., Gatorade®, is served in the paper cups.

It is also possible that cone-style cups (with a pointed rather than flat base) could be used.

These water cups always have an open top, so that when the runner picks up the cup, much of the water (or other hydrating beverage) spills or splashes out. Many runners will crush or fold in the top part of the cup to try and prevent spilling, but this also results in some of the water spilling or squirting out, and moreover it is difficult to form any sort of drinking spout when the top is just crushed in that fashion.

There has been a need, and the need remains, for an inexpensive, disposable paper cup that can be used at water stations at road races, and which can be easily filled with water (or other beverage) and closed by volunteers at the water station, so the volunteers can hand off the cups to the runners without significant spillage. The closed cup limits fluid spillage during transfer from the volunteer to the racer when the racer grabs a cup from the table or from the volunteer. It is most desirable if the cup would also form a drink spout or opening when the flaps are folded in, so the runner can easily sip from the cup. The closed cup also allows more of the fluid to be drunk by the runner, for better hydration during the event. So that the cup can to be gripped with either hand of the runner or the volunteer at the water station, the cup should be symmetrical, so that it can close without any difficulty. However, to date no such disposable cup has been available.

A number of one-piece drink cups or containers have been proposed, e.g., for coffee, tea, or soft drinks, with built-in closures that can be folded down after the container is filled. However, these tend to be rather elaborate, with asymmetrical cuts and folds. As they have been specifically designed for coffee or similar beverage, they are not well suited for road-race water station use. Moreover, these fold-in coffee containers are costly to fabricate and produce, and would be too expensive for one-time use where there are multiple water stations and hundreds, or often thousands, of participants.

This would be especially problematic where the distance run is being operated by a non-profit organization with a low budget for such supplies.

OBJECTS AND SUMMARY OF THE INVENTION

It is an object of the present invention to provide a simple, inexpensive disposable cup suitable for use at water stations at distance running events, and which avoids the drawbacks of the prior art.

It is another object to provide a disposable drink cup that can be grabbed by the participant runner with either hand, and which forms a drink opening or spout at one side that permits the runner to sip easily from the cup without potential discomfort or danger from inhaling fluids.

It is an object that spillage be minimized and hydration be increased.

It is a further object to provide a drink cup that is of simple design in which a pair of arcuate flaps fold down on arcuate fold lines, and flat, generally straight sides of the flaps form the drinking spout.

In accordance with an aspect of the present invention, a drink cup that is adapted for use at a water station of a running event has a conic side wall formed of a stiff but flexible material (plastic-coated paper, uncoated paper, or biodegradable paper), and a bottom that closes off a lower end of the conic side wall. The conic side wall is formed with left and right fold-down closure flaps at the upper end of the conic side wall. Each of closure flaps is in the form of a secant ogive. Flat (i.e., straight) ends of the secant ogive closure flaps are disposed at a proximal side of the drink cup with the flat ends of the closure flaps being spaced apart to define a drink spout. The closure flaps each have a pointed end, and the pointed ends meet one another at a common point at a distal side of the cup, diametrically opposite the drink spout.

In a preferred embodiment, the drink spout is defined by a horizontal cut line joining lower ends of the flat ends of the left and right flaps, and the flat ends are formed as vertical edges that extend substantially along respective radii of said conic wall (i.e., the lines that radiate from the conic apex). Each of said left and right flaps has an arcuate upper edge following a circular arc from an upper edge of the respective vertical edge to common point on the distal side of the drink cup. Favorably, the left and right flaps also comprise an arcuate fold line extending from a lower end of the flat end of the associated flap to the common point at the distal side of the cup. In the preferred embodiment, the arcuate fold lines are perforated.

In some preferred embodiments, the drink cup comprises a conic side wall formed of a plastic-coated, uncoated or biodegradable paper material and having an upper edge defined by a generally square recess formed on a proximal side of the cup. Right and left arcuate flaps are each formed as a secant ogive having a flat (i.e., straight) end defined by a respective vertical edge of the square recess. Each of the flaps has an upper arcuate edge that extends from an upper end of the respective vertical edge of the square recess to a distal common point that is diametrically opposite the recess. Each of the left and right flaps has an arcuate (preferably perforated) fold line that extends from a lower end of the associated vertical edge to the common point at the distal side of said cup.

The upper arcuate edges and said lower arcuate fold lines each have a given radius of curvature and those radii of curvature are substantially equal to one another. In the disclosed embodiment, the five-ounce drink cup has is provided with secant ogive flaps where the upper arcuate edges and the lower arcuate fold lines all have a curvature radius of three inches. The cups are not limited to this size.

Either flap can be pushed down first, with the other flap being pushed down on top of it. This leaves a drink opening or spout, in the form of a slot, that is about three-quarters inch across at the proximal side of the cup. The flaps when folded down just touch the opposite sides of the cup, so that there is enough closure provided by the two flaps to keep the water from splashing out of the cup, but the two flaps are loose enough to permit air flow so that it is easy for the runner to sip or drink from the drink spout.

The simple design of this drink cup allows the cups to be fabricated easily and at low cost. These may be fabricated by forming cuts and folds in a larger inexpensive disposable cup (e.g., a nine-ounce or ten-ounce paper cup) to produce the desired five-ounce or six-ounce cup. Alternatively, the cups can be fabricated from paper blanks. In either event, a minimum number of dies are needed to create the cuts and folds (with perforations), so the cups can be manufactured economically in quantities to satisfy the needs of the running-event organizers.

Alternatives and variations of this drink cup are also possible. The main aspects of the invention will become apparent from the ensuing description of a preferred embodiment, given in connection with the accompany Drawing figures.

DETAILED DESCRIPTION OF THE PRESENT INVENTION

Figure 1:
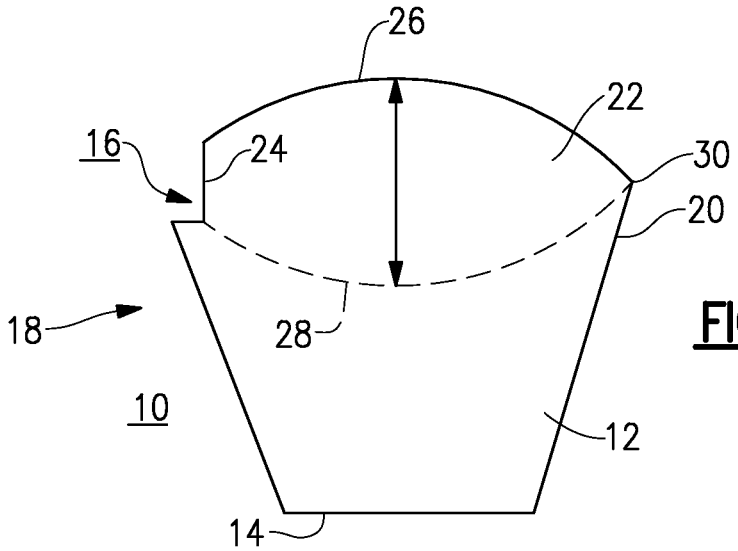
FIG. 1 is a side elevation of the drink cup according to one embodiment of this invention.
Figure 2:
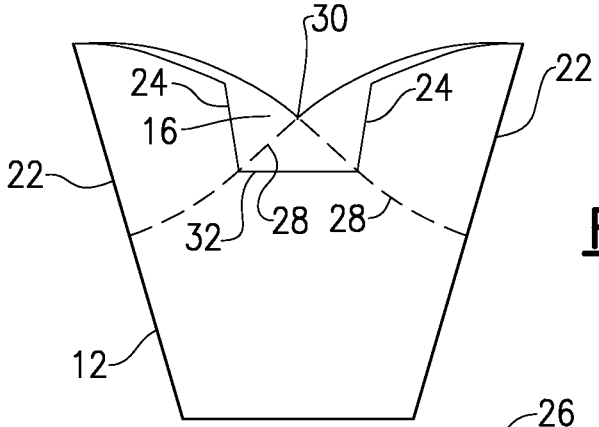
FIG. 2 is a front or proximal elevation thereof.
Figure 3:
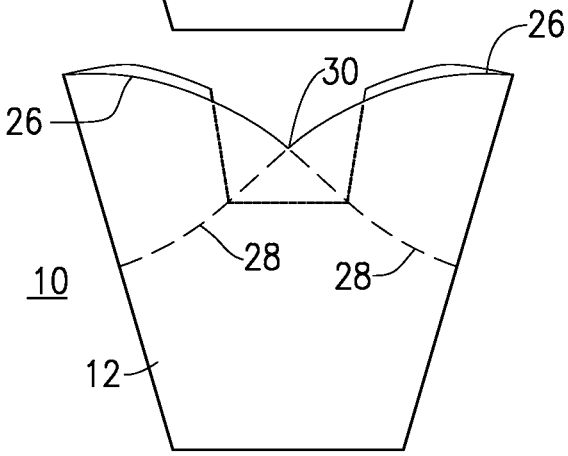
FIG. 3 is a rear or distal elevation thereof.

Referring now to FIGS. 1 to 3, a paper drink cup 10 according to one embodiment of this invention is formed of a generally conic (or frustoconic) side wall 12, and a bottom 14, here a flat disk, which closes off the bottom of the side wall. A generally square cut out or recess 16 is formed at the proximal side 18 of the cup, i.e., to the left in FIG. 1. The distal or rear side 20 of the cup is shown to the right in FIG. 1. A pair of fold-down flaps or closures 22 (only one of which is visible in FIG. 1) are each defined by a vertical flat edge or straight cut line 24 that forms a side edge of the cut out 16, an arcuate top edge or cut line 26 and a lower arcuate fold line 28, here a perforated line. The upper cut lines 26 and lower fold lines 28 all have the same radius of curvature, here three inches, in the case of a five-ounce drink cup, and these arcuate lines 26 and 28 all meet at a common point 30 on the distal side 20 of the cup, with that point 30 being diametrically opposite the cutout 16.

The closure flaps 22 each have the shape of a secant ogive, which is to say, a pointed bullet-like shape formed of two intersecting arcs that meet at the point 30, with a flat end defined by the vertical flat or straight edge 24.

As shown in FIGS. 2 and 3, the cutout 16 has a horizontal, generally flat, base edge 32 that meets with the lower end of each of the vertical flat edges or cut lines 24. The upper arcuate edges or cut lines 26 each extend from the upper end of the respective vertical flat edge 24 to the common point 30, while the perforated arcuate lower fold lines 28 extend from the lower ends of the respective vertical flat edge 24 to the common point 30. The vertical orientation of the edges or cut lines 24 should be taken to mean that these extend along respective radii of the conic wall 12 when the latter is considered laid flat.

Figure 4:
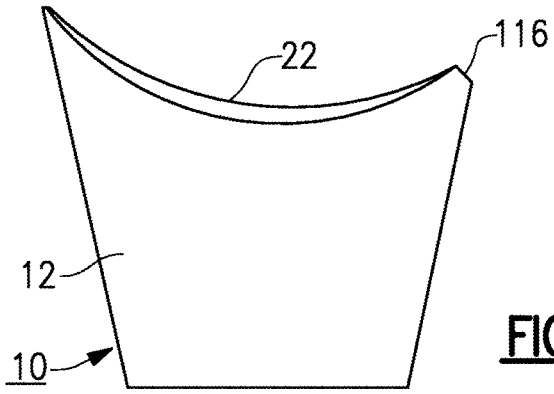
FIG. 4 is a side elevation thereof showing the flaps folded down.
Figure 5:
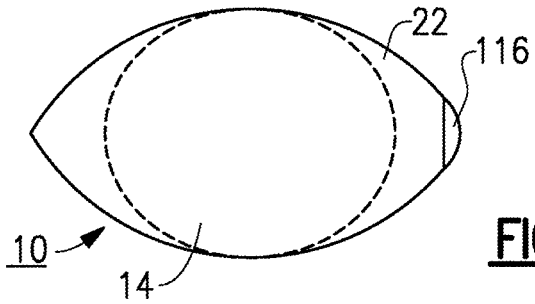
FIG. 5 is a top plan of the cup with the flaps folded down.

The ogive flap closures can be pushed down to close off the top of the drink cup 10, as shown in FIGS. 4 and 5. Each of the flaps 22 reaches across to the opposite side of the conic wall 12, so that the two flaps 22 lie one atop the other. This leave an open slot-like drink spout 116 at the position of the square cut out 16 on the front or proximal side 18 of the cup 10, shown to the right in these two views. As shown in FIG. 5, the folding down of the flaps 22 changes the shape of the cup 20 to being more pointed proximal-distal. The bottom 14 here is shown in broken lines as a flat disk.

Figure 6:
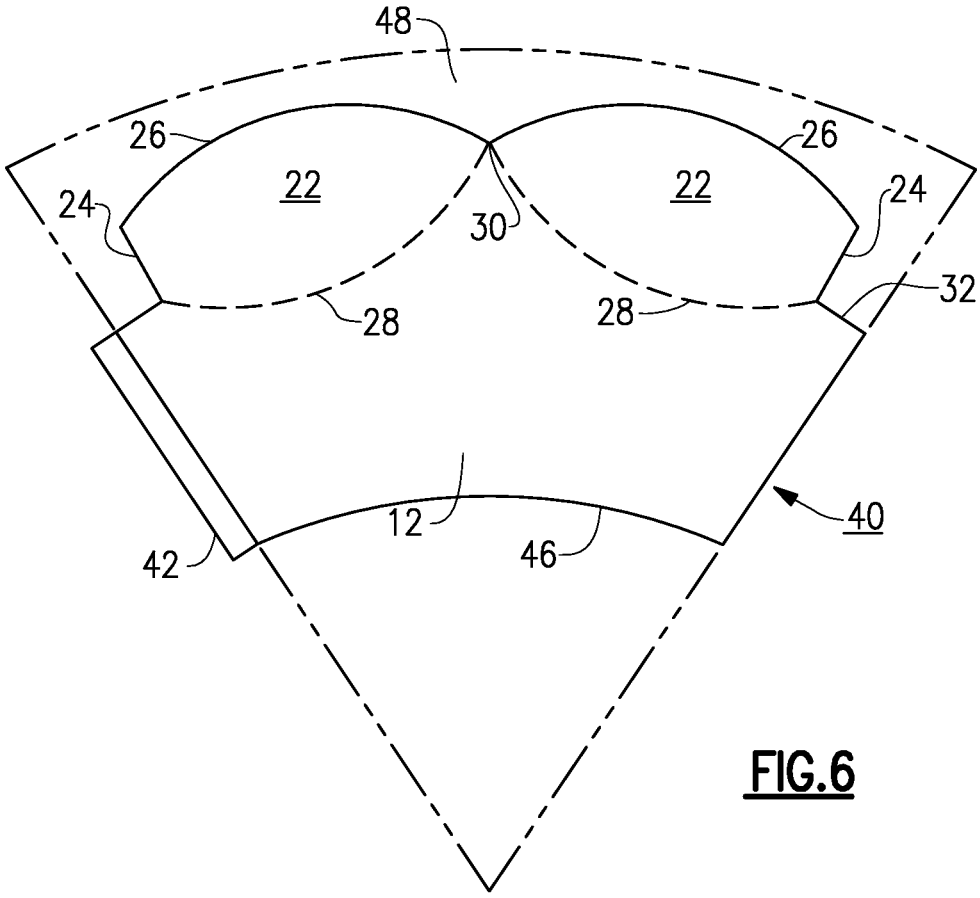
FIG. 6 illustrates a flat blank from which the cup of this invention may be formed.

One possible technique for forming the drink cup can involve forming a flat blank 40 as generally shown in FIG. 6, which can be rolled into a conic form with a bottom or base to create the drink cup. Here, the blank 40 is shown as a segment of a disk with a seam 42 extending along a radius of the blank 40, which can be joined and glued to an opposite edge. An arcuate lower edge 46 is at the position at which a bottom closure is to be affixed. A radially outward edge of the blank 40 is shown in dot-dash lines. At the radially outward portion of the blank 40 are illustrated the horizontal cut line 32 and vertical (or radial) cut lines 24 that form the square cut out 16, as well as the upper arcuate cut lines 26 and lower arcuate perforated fold lines 28 that extend from the respective vertical cut lines 24 and meet at the common point 30, and which together define the two, mirror-image secant ogive closure flaps 22, 22. Between these cut lines and the radially outward edge (shown by dot-dash line) is a waste area 48. The waste area can be minimized by design of die layout.

Figure 7A:
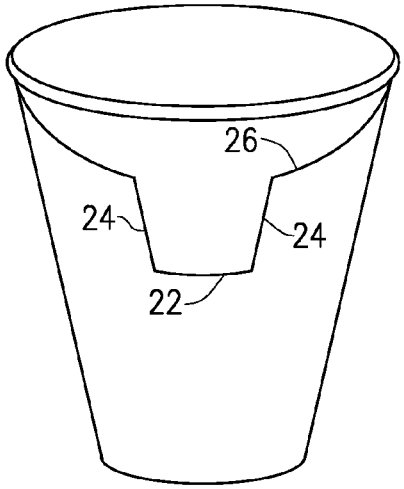
FIG. 7A is a proximal view of a standard cup showing cut lines for forming the proximal cutout and the upper arcuate edges for the flaps of this embodiment.
Figure 7B:
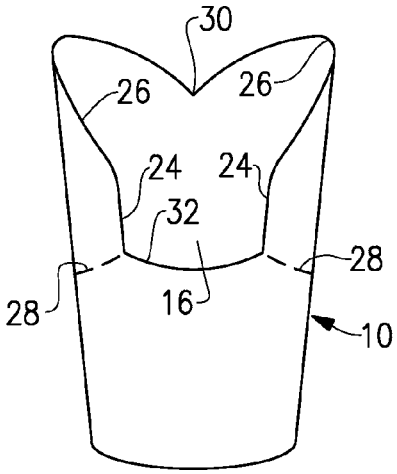
FIG. 7B is a similar proximal view of the cup of this invention.
Figure 8A:
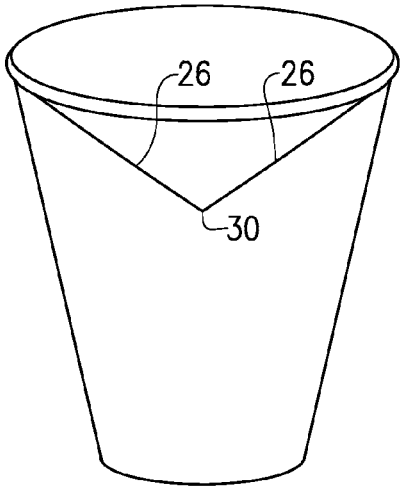
FIG. 8A is a distal view of a standard cup showing cut lines for forming the arcuate edges for the flaps.
Figure 8B:
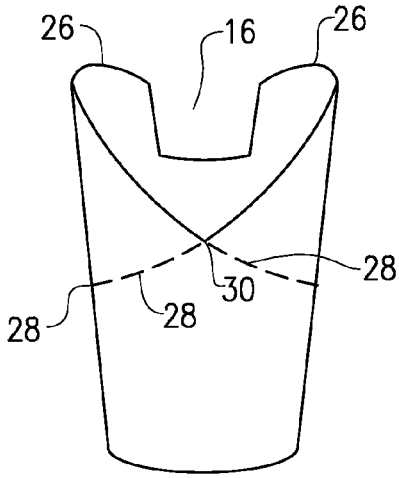
FIG. 8B is a similar distal view of the cup of this invention.

FIG. 7A shows a standard nine-ounce paper cup marked with the cut lines for the horizontal line 32 and vertical lines 24 that form the cutout 16, and with the curved lines 26 that form the upper edges of the fold down flaps. FIG. 7A illustrates these from the proximal side of the cup. FIG. 7B then shows the resulting cup 10 after the cuts have been made, with the arcuate perforated fold lines 28 also shown here, to define the ogive-shaped fold-down flaps 22, 22. FIG. 8A shows the nine-ounce paper cup with the cut lines marked, but here shown from the distal side 20, where the arcuate lines 26 meet at the common point 30. FIG. 8B shows the cup 10 from the distal side, after the cuts have been made and after the fold lines 28 formed.

The drink cup 10 of this invention can thus easily be formed from a larger paper cup, by forming the curved and straight cuts as shown and by perforating along the lower fold lines. This can involve a minimum number of dies or knives on a forming press to cut down the larger cups, and can be automated so that the large number of drink cups needed for a road race event can be quickly and economically produced from low-cost starting materials. The cup shape allows the cups to be stacked prior to filling or fluid placement.

Figure 9:
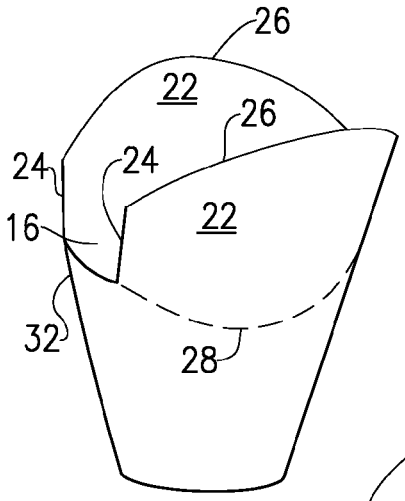
FIGS. 9, 10, and 11 are perspective views of the cup of this embodiment shown with the closure flaps open, with one flap closed, and with both flaps closed, respectively.
Figure 10:
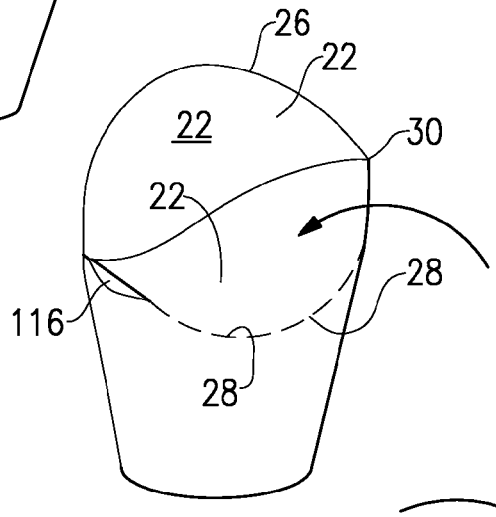
Figure 11:
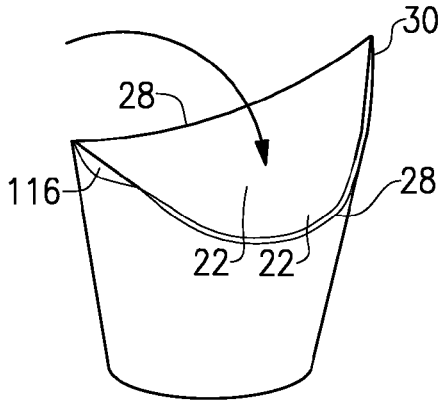

FIGS. 9, 10, and 11 show the cup 10 of this embodiment, first in an open condition with both flap closures 22 open (FIG. 9), ready for the cup to be filled with water, electrolyte solution, or other re-hydrating drink. Then (FIG. 10) one of the two flaps is pushed down, after which the other flap 22 is pushed down over the first flap (FIG. 11). This covers the liquid within the cup to prevent spilling or splashing. Also, the proximal edges 24 of the flaps 22 together with the horizontal edge 32 form a slot-like drink spout or opening 116 that allows the user to sip comfortably from the drink cup. In this view, the drink spout 116 is at the lower left, and on the proximal side, i.e., the side towards the user.

In many equivalent embodiments, the curved or arcuate edges of the flap closures 22 do not need to be strictly circular, but should be formed so as to close over the contents of the cup when the flaps fold one over the other, and bridge to the other side of the drink cup, just making contact.

Most favorably, these drink cups may be made of a natural fiber paper that is capable of decomposing naturally. The intention is that these be used once only, and also their construction allows for the fact that many of these will be discarded away from the water stations where a clean-up crew may later have difficulty collecting them. Uncoated paper or plastic-coated paper materials can also be used to produce the cup.

The foregoing description and drawings present an embodiment of this invention for the purpose of explaining the invention. However, the invention is not limited to the disclosed embodiment, but rather many modifications and variations thereof would present themselves to persons skilled in the art without departing from the scope and spirit of the invention as defined in the appended Claims.

The invention claimed is:

1. A drink cup comprising a conic side wall formed of a stiff but flexible material, and a bottom that closes off a lower end of said conic side wall;

the conic side wall being formed with left and right fold-down closure flaps at an upper end of the conic side wall; each of said closure flaps being in the form of a secant ogive having a flat end at a proximal side of the drink cup with the flat ends of the closure flaps being spaced apart to define a drink spout; and the closure flaps each having a pointed end, the pointed ends meeting one another at a common point at a distal side of the cup and diametrically opposite said drink spout, wherein each of said left and right closure flaps has an arcuate upper edge following a continuous circular arc from an upper edge of the respective said vertical edge to said common point on the distal side of the drink cup, and wherein said left and right closure flaps also each have an arcuate fold line extending in a continuous circular arc from a lower end of the flat end of the associated flap to the common point at the distal side of the cup, and wherein the upper edges of the left and right closure flaps and the arcuate fold lines of said left and right closure flaps all have radii of curvature equal to one another, such that when the closure flaps are pushed down each of the closure flaps reaches across to an opposite side of the conic side wall with one of the right and left closure flaps lying atop and substantially coextensive with the other of the closure flaps, and with the arcuate upper edge of each closure flap lying substantially along the arcuate fold line of the other closure flap.

2. The drink cup of claim 1 in which the flexible material is a plastic-coated paper.

3. The drink cup of claim 1 in which the flexible material is an uncoated paper.

4. The drink cup of claim 1 in which the flexible material is a biodegradable paper.

5. The drink cup of claim 1 in which said drink spout is defined by a cut line joining lower ends of the flat ends of the left and right flaps, and said flat ends are formed as vertical edges that extend substantially along respective radii of said conic wall, and configured such that when the closure flaps are folded down, the flat ends of the closure flaps lie one atop the other and extend across the resulting drink spout.

6. The drink cup of claim 1 wherein each said arcuate fold line is perforated.

7. A drink cup comprising a conic side wall formed of a paper material, the material selected from the group consisting of uncoated paper, plastic coated paper, and biodegradable paper, the drink cup having an upper edge defined by a generally square recess formed on a proximal side thereof and right and left arcuate closure flaps each formed as a secant ogive having a flat end defined by a respective vertical edge of said square recess, each of said closure flaps having an upper arcuate edge that extends in a continuous circular arc from an upper end of the respective vertical edge of the square recess to a distal common point that is diametrically opposite said recess, and each of said left and right closure flaps having an arcuate fold line that extends in a continuous circular arc from a lower end of the associated vertical edge to said common point at the distal side of said cup; and wherein the upper edges of the left and right closure flaps and the arcuate fold lines of said left and right closure flaps all have radii of curvature equal to one another, such that when the closure flaps are pushed down each of the closure flaps reaches across to an opposite side of the conic side wall with one of the right and left closure flaps lying atop and substantially coextensive with the other of the closure flaps, and with the arcuate upper edge of each closure flap lying substantially along the arcuate fold line of the other closure flap.

8. The drink cup of claim 7 wherein said lower arcuate fold lines are perforated lines.

* * * * *